US005114164A

United States Patent [19]

Bothwell et al.

[11] Patent Number: 5,114,164

[45] Date of Patent: May 19, 1992

[54] CASE

[76] Inventors: Peter W. Bothwell; Roy Bothwell, both of "Meoncote" 114 Shipston Road, Stratford upon Avon, Warwickshire, United Kingdom

[21] Appl. No.: 337,270

[22] Filed: Apr. 13, 1989

[51] Int. Cl.[5] ..... A45C 5/14

[52] U.S. Cl. ..... 280/37; 190/18 A; 280/43.1; 280/655

[58] Field of Search ..... 190/18 A; 280/37, 655, 280/641, 645, 43.1

[56] References Cited

U.S. PATENT DOCUMENTS

| | | | |
|---|---|---|---|
| 1,895,677 | 1/1933 | Pinheiro | 280/37 |
| 2,110,791 | 3/1938 | Denormandie | 190/18 A |
| 2,510,754 | 6/1950 | Norlin | 280/38 |
| 3,141,680 | 7/1964 | McCord et al. | 280/38 |
| 3,178,197 | 4/1965 | Boatner | 280/37 |
| 3,522,955 | 8/1970 | Warner | 280/47.37 |
| 3,709,513 | 1/1973 | Cassimally | 280/37 |
| 3,960,252 | 6/1976 | Cassimally | 280/37 |
| 4,026,569 | 5/1977 | Staal | 280/37 |
| 4,036,336 | 7/1977 | Burtley | 190/18 A |
| 4,122,924 | 10/1978 | Wasserman | 280/37 |
| 4,254,850 | 3/1981 | Knowles | 280/645 |
| 4,261,447 | 4/1981 | Arias et al. | 280/47.26 |
| 4,273,222 | 6/1981 | Cassimally | 280/37 |
| 4,526,399 | 7/1985 | Holtz | 280/655 |

FOREIGN PATENT DOCUMENTS

| | | | |
|---|---|---|---|
| 0187318 | 12/1985 | European Pat. Off. . | |
| 806704 | 4/1951 | Fed. Rep. of Germany . | |
| 1184472 | 12/1964 | Fed. Rep. of Germany . | |
| 2063620 | 7/1971 | Fed. Rep. of Germany . | |
| 2014271 | 10/1971 | Fed. Rep. of Germany . | |
| 0142770 | 11/1984 | Fed. Rep. of Germany . | |
| 3339913 | 5/1985 | Fed. Rep. of Germany . | |
| 0867582 | 11/1941 | France | 190/18 A |
| 2598897 | 11/1987 | France | 190/18 A |
| 655641 | 7/1951 | United Kingdom . | |
| 1444998 | 8/1976 | United Kingdom . | |
| 1512020 | 5/1978 | United Kingdom . | |
| 1581310 | 12/1980 | United Kingdom . | |
| 2124589 | 2/1984 | United Kingdom . | |
| 2135638 | 9/1984 | United Kingdom . | |
| 2168035 | 6/1986 | United Kingdom . | |
| 2197637 | 5/1988 | United Kingdom | 190/18 A |

*Primary Examiner*—David M. Mitchell
*Attorney, Agent, or Firm*—Armstrong, Nikaido, Marmelstein, Kubovcok & Murray

[57] ABSTRACT

A suitcase incorporates a foldable handle assembly (22) and wheels (15,16) which are automatically moved into protruding positions when the handle assembly is extended. With the extended handle upright, a major face of the case is substantially horizontal and further cases can be stacked on the case, which serves as a trolley.

15 Claims, 5 Drawing Sheets

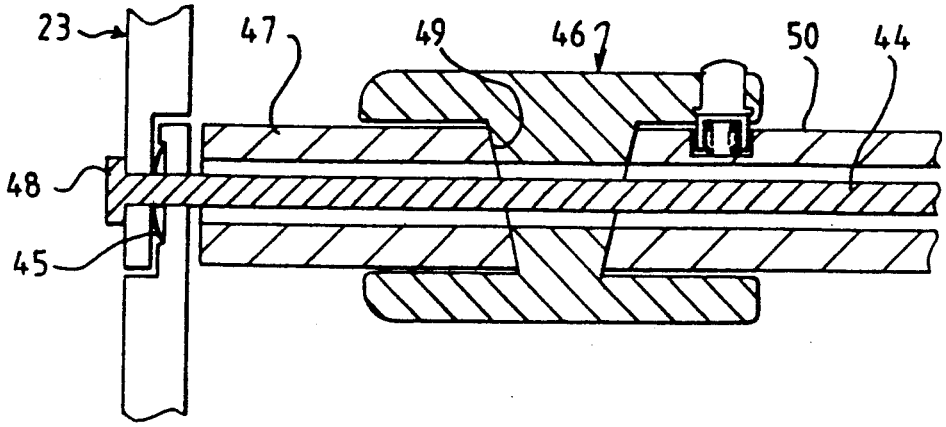
FIG 7
FIG 8
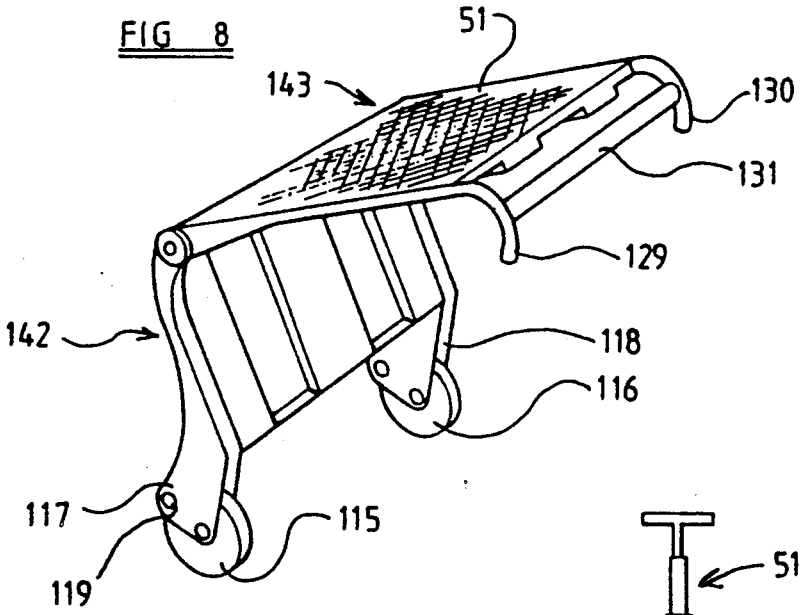
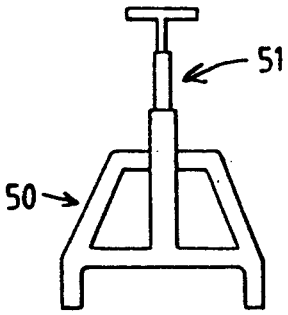
FIG 9

CASE

BACKGROUND TO THE INVENTION

The present invention relates to a case of the kind incorporating wheels for supporting the case on a floor so that the case can be wheeled about. Examples of disclosures known to the present applicants of cases having wheels are U.S. Pat. No. 4,036,336, U.S. Pat. No. 3,522,955, DE No. 1184472, DE No. 3339913 and U.S. Pat. No. 4,261,477. The latter two references disclose retractable handles but these handles are mounted independently of the wheels.

Wheels which rotate about axes which are fixed with respect to the outside of the main body of a case are likely to suffer damage and are likely to cause damage to other articles, particularly if the wheels are large. Small wheels are unsatisfactory for wheeling a case over a floor which has irregularities. In U.S. Pat. No. 4,122,924, U.S. Pat. No. 1,895,677, GB No. 1,581,310, GB No. 1,512,020, GB No. 2,124,589. DE No. 201271 and EP No. 187318, there are disclosed cases having retractable wheels and handles mounted independently of the wheels. The arrangements for extension and retraction of the wheels and handles are inconvenient. DE No. 806704 discloses retractable wheels and a handle which is detatchably mounted on the wheels. However, extension and retraction of the wheels is still inconvenient and must be performed individually for each wheel.

In U.S. Pat. No. 3,178,197, there is proposed a case having retractable wheels, a telescopic handle and a rack and pinion mechanism connecting the handle with respective carriers of the wheels, the arrangement being such that extension of the handle causes the wheels automatically to project from the body of the case. This avoids some of the inconvenience of the aforementioned proposals but the rack and pinion mechanism, if of sufficiently robust construction to operate reliably and freely over a prolonged service life, will necessarily contribute considerably to the weight of the case. Furthermore, a substantial proportion of the overall volume of the case is required to accommodate the wheels, wheel carrier and rack and pinion mechanism.

Disclosures of cases having retractable wheels mounted on respective pivoted carriers, movable handles and linkages connecting the handles with the wheel carriers are U.S. Pat. No. 3,141,680, U.S. Pat. No. 4,254,850, U.S. Pat. No. 2,510,754, GB No. 655,641, GB No. 1,444,998, GB No. 2,168,035, GB No. 2,135,638 and EP No. 142770. The case proposed in the latter specification has four wheels positioned near to respective corners of one major face of the case so that, when the case rests on its wheels, the opposite major face is at least approximately horizontal and provides a suitable platform to receive a stack of additional cases. Thus, the case disclosed in EP 142770 is suitable for carrying several additional cases. Furthermore, the case will be stable, when standing on a flat floor on all of its wheels, even when bearing a heavy load of additional cases. However, the wheels of the case disclosed in EP No. 142770 are small and are therefore unsuitable for supporting a heavy load of cases for movement on a floor which has any irregularities. Furthermore, a considerable proportion of the overall volume of the case must be devoted to accommodation of the retracted wheels and of the linkage connecting the wheel carriers to one another and to the handle. The wheels, linkage and handle contribute considerably to the weight and to the cost of the case.

In order to minimise the complexity and cost of a case, improve robustness and reliability and to maximise the proportion of the overall volume of the case which is available for the accommodation of articles to be transported, it is desirable to avoid the provision of a linkage between wheel carriers and a handle. One approach to attaining this result is proposed in U.S. Pat. No. 4,273,222 where there is proposed a case having a pair of retractable wheels mounted on respective carriers which are pivoted to the main body of the case. An articulated mast, which incorporates a handle, is also pivotally connected with the body. The mast is arranged to co-operate with the wheel carriers to drive the wheels to their projected positions when the mast is raised. When the mast is lowered to the body of the case, the wheel carriers are released for return to their retracted positions by springs. During raising of the mast, the mast and the wheel carriers are pivoted in opposite directions about respective pivots relative to the body of the case.

Proper operation of the mechanism disclosed in U.S. Pat. No. 4,273,222 is dependent upon the maintenance of the required geometry, within close tolerances. With the mast extended, the case is suitable for supporting a stack of additional cases which will impose a heavy load. In order for the required geometry to be maintained when the case is heavily stressed, the case must be of particularly robust construction. This, in combination with the small tolerances permitted, results in an expensive structure. If low weight also is to be attained, for example by the use of composite materials, even greater expense is entailed.

An alternative approach to the provision of a case which has no linkage between the wheel carriers and the handle and which is suitable, when in an extended configuration, for supporting a stack of additional cases, is disclosed in DE No. 2063620. This specification discloses a case having an articulated mast which is connected with a main body of the case for pivoting relative thereto about a pivot axis which lies near to a corner of the case. The wheels are mounted on respective carriers which are fixed to the mast. Pivoting of the mast relative to the body of the case is limited to a range of less than 90°. One consequence of this is that, when the case is in the extended configuration and is used for wheeling a stack of cases on a floor, the clearance between the body of the case and the floor is small. On an uneven floor, for example at a threshold, there is a risk of the case body grounding. This will prevent free wheeling of the case and will result in damage being caused to the case.

The mast of the case proposed in DE No. 2063620 must be open to receive the body of the case between side members of the mast, when the case is in a retracted configuration. The open mast, when in the extended configuration, is an unsatisfactory support for additional cases because these may fall between the side members of the mast.

The wheels of the case proposed in DE No. 2063620, when in the extended configuration, are so positioned that the case cannot stand in a stable manner on a floor whilst supporting a stack of additional cases and with the wheels engaged with the floor. The case can stand in a stable manner on one major face whilst a stack of additional cases is supported on the opposite major face but the wheels will then be raised from the floor. This will inevitably cause damage to the body of the case. Furthermore, the loaded case cannot easily be tipped to bring the wheels into contact with the floor and to raise the body from the floor, for wheeling. This problem is further exacerbated by the fact that the wheels are positioned about as far as possible from the centre of gravity of the case and from the vertical plane containing the centre of gravity of a stack of loaded cases, when the case rests in a stable manner on a floor with the mast upright. Considerable leverage must be applied to tip the loaded case back on to its wheels. Furthermore, remoteness of the wheels from the centre of gravity impairs the stability of the loaded case during wheeling. If the mast is tipped sufficiently far towards the horizontal to bring the centre of gravity over the wheels, then the handle portion of the mast will be at an inconvenient low level.

In one embodiment proposed in DE No. 2063620, the wheels, wheel carriers and mast lie outside the main body of the case, even when in the retracted configuration. This arrangement is likely to result in damage being caused to the case and to other articles with which it comes into contact during handling, particularly mechanical handling on conveyors and carousels. It is proposed in DE No. 2063620 that housings for the wheels and wheel carriers and for an adjacent part of the mast should be incorporated in the main body of the case. These housings constitute a substantial proportion of the overall volume of the case and represent space which is not available for containing articles to be contained in the case, since the housings must be unobstructed, as the mast sweeps through the housings during extension of the mast.

It is an object of the present invention, to provide a case in which one or more of the foregoing disadvantages is avoided.

SUMMARY OF THE INVENTION

According to one aspect of the present invention, there is provided a case comprising a hollow body with a pair of opposite, external, major faces and minor faces extending between the major faces, a mast and a pair of wheels mounted on the mast for rotation relative thereto about a common wheel axis, wherein the mast is mounted on the body for pivoting of the mast and wheels together about a pivot axis common to the mast and the wheels between an extended configuration and a contracted configuration, wherein, in the extended configuration, the mast extends from the body in a direction from one major to the other major face, wherein said pivot axis is transverse to said direction and wherein, in the contracted configuration, the mast extends from the pivot axis through a plane containing the wheel axis and then extends away from the wheels at the side of the said plane remote from the pivot axis, said plane lying between the major faces of the body.

Each of the major faces may be generally rectangular, in which case there will be four minor faces. The minor faces may merge with each other at curved corners of the case. The major faces also may merge with the minor faces at curved edges of the case. The body has a lid which preferably includes at least a part of one of the major faces of the body.

One of the major faces preferably includes a substantially flat surface portion which provides a suitable platform for receiving additional cases. This major face is the one from which the mast extends when in the extended configuration. The opposite major face may be generally flat but preferably bulges in a direction away from the one major face. The bulge is preferably most pronounced at a position spaced beyond the centre of the face in a direction away from the wheel axis, when the case is in the extended configuration, the bulge then being suitable for engaging a floor when the case is parked resting on its wheels.

The mast may be an articulated mast or telescopic mast. Thus, the mast may comprise at least two relatively movable parts, one of which incorporates a handle for use when the case is being wheeled on a floor and the other of which parts extends past the wheels to the pivot axis. These parts of the mast may be connected to one another for relative pivoting or for relative sliding.

The mast may be of generally open form. In this case, the mast preferably comprises opposite side members and transverse members extending between the side members to form a grid-like structure, against which additional cases can rest when the case is in the extended configuration and bears a stack of additional cases. Alternatively, the mast may be of web-like form, for example being a plate-like moulding of a plastics material or comprising a web of flexible material supported on a relatively rigid frame.

In the contracted configuration, the mast preferably lies mainly at a major face of the body, that is the major face from which the mast extends, when the case is in the extended configuration.

The preferred form of the mast incorporates a bell-crank lever having a longer arm and a shorter arm meeting at an apex of the lever, with the pivot axis lying near to a free-end of the shorter arm, the wheel axis lying near to the apex of the lever and the longer arm incorporating the articulated or telescopic joint of the mast.

BRIEF DESCRIPTION OF THE DRAWINGS

An example of a case embodying the invention and modifications of the case are shown in the accompanying drawings, wherein:-

FIG. 7 shows a partial cross-section through the mast, illustrating a lock for a pivot joint of the mast, FIG. 8 is a diagram reopresenting an alternative form of mast separated from the body of the case, FIG. 9 is a diagrammatic illustration of a further alternative form of mast, separated from the case body.

Figure 1:
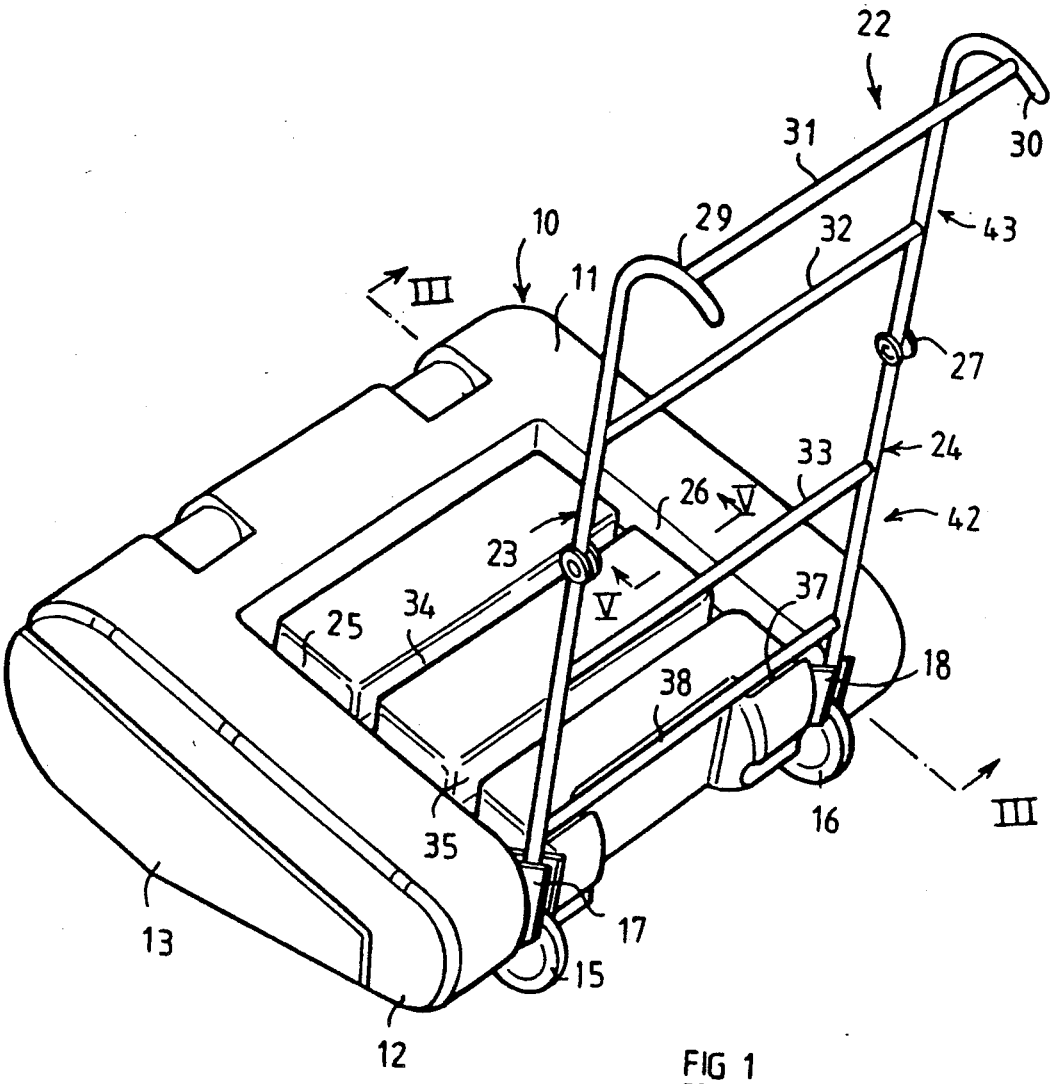
FIG. 1 shows a perspective view of the case with a mast of the case extended so that the case is in a suitable condition to serve as a trolley for transporting additional cases.

The case illustrated in the accompanying drawings comprises a hollow body 10 which includes a generally rectangular major wall 11 and peripheral wall portions 12 which are transverse to the major wall. The walls 11 and 12 collectively define a cavity open at one side and the case further comprises a lid 13 for closing the open side of the cavity. The lid is connected with one of the peripheral wall portions 12 by a hinge 14.

The case further comprises a pair of wheels 15 and 16 rotatably mounted on respective carriers 17 and 18. The carriers are connected with the body 10 for pivoting relative thereto about a common pivot axis 19 between the stowed position illustrated in FIG. 4 and the protruding position illustrated in FIG. 3. When the wheels and carriers are in the protruding position, the wheels protrude from a major face 21 of the case which is presented partly by the lid 13 and partly by the body 10. In the stowed position, the wheels and carriers lie entirely within recesses defined by the body 10.

The major face 21 and the opposite major face 41 of the case are both generally rectangular. Accordingly, the case has four minor faces presented by the wall portion 12. Adjacent faces of the case merge with one another through rounded corners. The rounding of the corners is preferably more pronouced than illustrated in the drawings. The major faces 21 and 41 may have shapes other than rectangular shapes, in which case the number of minor faces would differ correspondingly. For example, each major face may have an oval shape with approximately straight opposite margins or may have a polygonal shape with a number of sides greater than four. A minor face which is remote from the wheels 15 and 16 preferably includes a substantially flat surface portion (see FIG. 3) by which the case can rest on flat floor surface in a stable manner and in the attitude illustrated in FIG. 2.

It will be noted that, when the wheels and carriers 17,18 are in the stowed position (see FIG. 4), the pivot axis 19 lies nearer to the centre of the body 10 than does the axis of rotation 20, which is common to both of the wheels 15, 16. Furthermore, in the stowed position, the pivot axis 19 lies nearer than does the wheel axis 20 to the major face 21 of the case which is presented partly by the lid 13. In the stowed position, the wheel axis lies approximately mid-way between the opposed major faces of the case and the first pivot axis 19 lies at least twice as far from the major face 41 presented by the wall 11 as the axis 19 is from the face 21. When the wheels and carriers are moved from the stowed position to the protruding position, they move through an angle within the range 60° to 120° about the pivot axis 19. In the protruding position (see FIG. 3), the wheel axis 20 lies near to but at the outside of the major face 21 of the case presented partly by the lid 13. Accordingly, somewhat more than half of each wheel protrudes beyond that face. The distance between the axes 19 and 20 is at least as great as the radius of the wheels but is preferably less than the diameter of the wheels.

Figure 4:
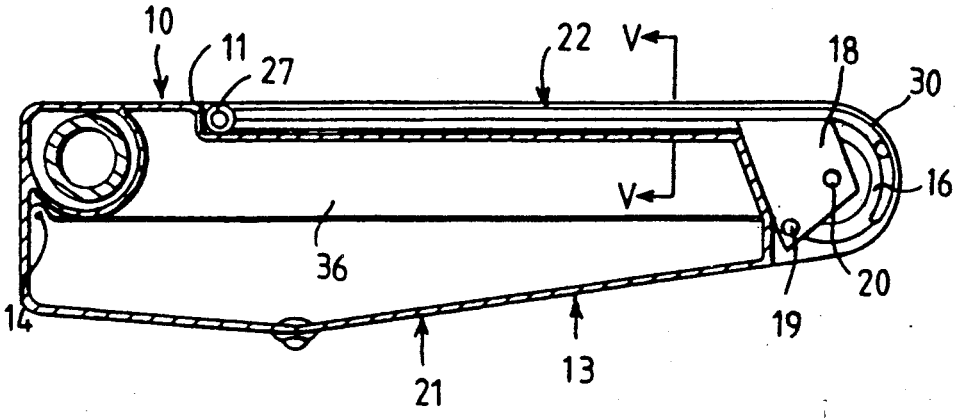
FIG. 4 shows a similar cross-section of the case with the mast in the contracted position.

As can be seen clearly from FIG. 4, the depth of the body 10 near to the wheels 15 and 16 is considerably less than is the overall depth of the body, when the case is in the generally horizontal attitude of FIG. 4. Accordingly, the diameter of the wheels is also considerably less than is the overall depth of the case. However, the diameter of the wheels is preferably at least as great as one half of the overall depth. Typically, the overall depth of the case is within the range 150 to 250 millimetre and the diameter of the wheels is at least 80 millimetre.

The wheel carriers 17 and 18 constitute respective parts of a mast which is indicated generally by the reference numeral 22. In the example illustrated in FIG. 1 to 6, the mast is an articulated structure comprising a lower mast part 42 which is rigid with the wheel carriers and an upper mast part 43 which includes hand grips 29 and 30. The mast parts 42 and 43 are connected together by a pivot joint 27 for relative pivoting about an axis which is parallel to the pivot axis 19. The pivot joint 27 is approximately half way up the mast when the mast extends upwardly from the body 10, as shown in FIG. 1.

The particular example of mast 22 shown in FIG. 1 comprises an articulated frame fabricated from lengths of metal tube and includes a pair of opposite, elongated side members 23 and 24 and a number of transverse members 31, 32, 33 and 38 extending between them. The number of transverse members may be varied from that shown and one or more openings defined by the frame may be spanned by a web of flexible material, for example a textile, to close the interior of the frame, at least partly.

Free-end portions of the side members 23 and 24 are curved to form handles 29, 30. The handles may be arcuate and the transverse member 31 extends between them. Opposite end portions of the side members 23 and 24 are rigidly secured to the wheel carriers 17 and 18, for example by rivets. Accordingly, the lower part 42 of the mast is constrained to move with the wheels and wheel carriers about the pivot axis 19.

Figure 5:
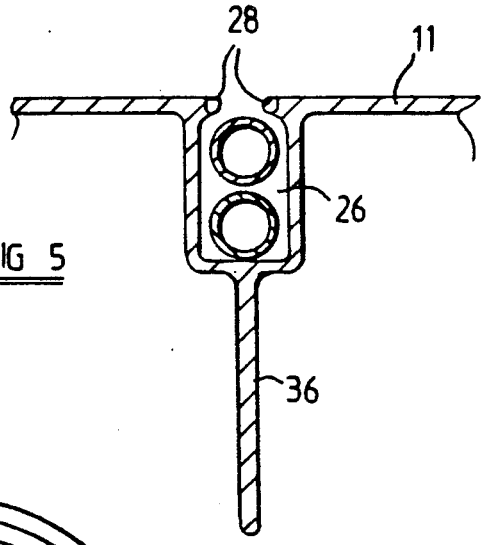
FIG. 5 shows, on an enlarged scale, a fragmentary cross-section on the line V—V of FIG. 4.

There is formed in the major face 11 of the body 10 an array of channels or other recesses suitable to receive that part of the mast 22 which extends upwardly from the face 11 when the case is in the extended configuration illustrated in FIG. 1. The case is converted to the contracted configuration illustrated in FIG. 4 by folding up the upper mast part 43 relative to the lower mast part 42 and pivoting of the mast, together with the wheel carriers and wheels, around the axis 19. The pivot joint 27 is preferably such that the two parts of each of the side members 23 and 24 can be folded one on top of the other, as shown in FIG. 5. The array of channels includes mutually parallel, rectilinear channels 25 and 26, each of which is suitably dimensioned to receive a corresponding one of the folded side members 23 and 24. As illustrated in FIG. 5, each of the channels 25 and 26 may have at its mouth opposed, resiliently flexible lips 28 which are spaced apart by a distance slightly less than the outside diameter of the side members 23 and 24 so that these members are trapped in the channels and the lips must be deformed resiliently during insertion of the side members into the channels and removal of the side members from the channels. The array of channels further comprises transverse channels 34 and 35 for receiving transverse members of the mast.

Figure 2:
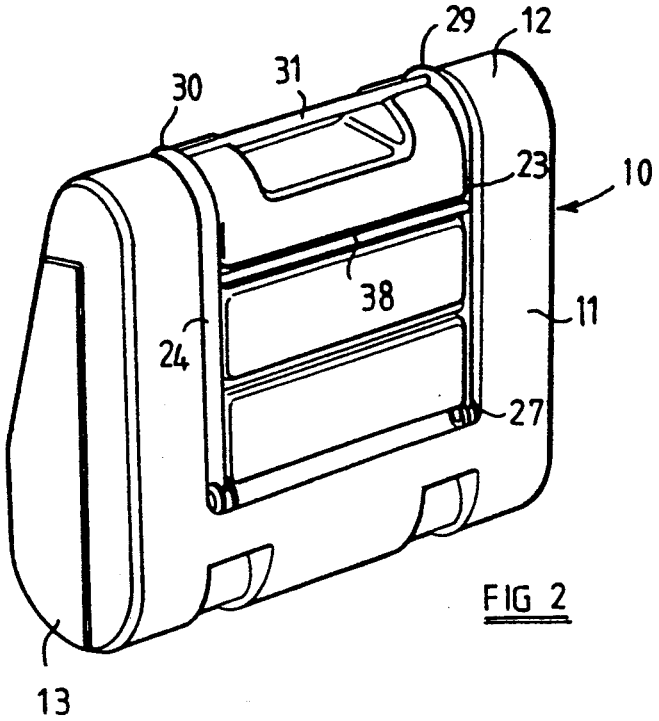
FIG. 2 shows a perspective view of the case with the mast in a contracted position so that the case is in a suitable condition to be loaded into a luggage compartment or to be transported on a conveyor.

When the case is in the contracted configuration illustrated in FIGS. 2 and 4, the hand grips 29 and 30 extend partly around the circumference of respective ones of the wheels 15 and 16 and lie entirely in recesses in the body 10 containing the wheels and wheel carries. The transverse member 31 which extends between the hand grips then lies in a recess formed in a peripheral wall portion of the body. The recess provides sufficient clearance around a central portion of the transverse member 31 to facilitate use of that transverse member as a carrying handle for the case.

The presence of the channels 25, 26, 34 and 35 in the wall 11 contributes substantially to the stiffness of that wall. Furthermore, as shown in FIG. 5, there may extend inwardly of the body from the base of each of these channels a corresponding web 36 which further stiffens the wall 11. Webs 36 may be associated only with the channels 25 and 26, these webs being spaced sufficiently far apart to receive between them a folded suit, possibly on a hanger.

Restraining means is provided for limiting pivoting of the mast 22 relative to the body 10 when the mast is moved from the contracted to the extended position. The restraining means may comprise a linkage between the mast and the body, flexible ties or telescopic connectors. In the example illustrated, there is formed on the body 10 an abutment 37 which is spaced from the pivot axis 19 in a direction away from the lower face 21. When the mast is in the extended position, the abutment 37 is engaged by transverse member 38 of the mast and this engagement limits pivoting of the mast relative to the body. A resilient latch may be provided to oppose inadvertent movement of the transverse member 38 from the abutment 37.

When the case is in the extended configuration illustrated in FIG. 1 and the mast 22 is substantially upright, the major face 41 provides a suitable platform for supporting a stack of additional cases (not shown) and these additional cases can rest against the mast. The case preferably comprises one or more straps 40 for holding such additional cases against the mast. The or each strap may be wound onto a corresponding reel disposed in a recess defined by the body 10 at a position remote from the wheels 15 and 16. The or each strap can be drawn upwardly from its reel around the additional cases and attached to the mast. Known means for holding the straps in a tightened condition may be provided. Each reel may be spring-loaded so that the strap will be retracted automatically, when released.

It will be noted that the body 10 functions as a cantilever beam when supporting additional cases and resting on the wheels 15 and 16 only. Tipping of loaded body 10 in an anti-clockwise direction, as viewed in FIG. 3, relative to the mast 22 is restrained by engagement of the abutment 37 of the body on the transverse member 38 of the mast. As can be seen from FIG. 3, the point on each wheel which will contact the ground is spaced somewhat forwards from the mast and therefore from the point of contact of the abutment 37 with the transverse member 38. Rearwardly directed force exerted on the hand grips 29 and 30, that is directed away from the stack of additional cases, can prevent the body 10 tipping downwards about the point of contact between the wheels and the floor and can tip the body in the opposite direction until the centre of gravity is over the wheel axis 20.

When in the extended configuration and with the mast generally upright, the case can rest on a level floor surface by the wheels 15 and 16 and by a further contact element 39 provided at the lower, major face 21. The position of the contact element relative to the face 11 is preferably such that the face 11 is substantially horizontal when the case rests on a horizontal floor by its wheels and contact element 39. The contact element 39 may be formed separately from and attached to the lid 13. The contact element may be movable relative to the lid between projecting and stowed positions. Alternatively, the contact element may be an integral part of the lid. In either case, the face 21 preferably bulges downwardly in the vicinity of the contact element so that the contact element protrudes slightly, if at all, from the immediately adjacent parts of the face 21. It will be appreciated that a fixed, substantial projection from the face 21 would be a source of inconvenience and potential damage to the case and to other articles with which the case may come into contact. The bulge of the face 21 avoids such a substantial projection, whilst providing for the face 11 to be horizontal when the case is at rest on a level floor.

A further advantage provided by the downward bulge of the lower face 21 is that the space within the bulge is available to contain clothing or other articles which are to be packed in the case. This shifts the centre of gravity of the fully occupied case somewhat in a direction from the major face 11 towards the lower face 21 and somewhat in a direction from the pivot axis 19 towards the hinge, as compared with the position which the centre of gravity would occupy if the bulge is omitted from the lid. This shift of the centre of gravity at least partly compensates for the mass of the mast 22 which is at the face 41.

The presence of the bulge in the lower face 21 also ensures that the major part of this lower face cannot come into contact with the floor, even when the case is parked and bears a stack of additional cases.

The position of the centre of gravity of the case in both the empty and packed conditions will be in the region between the contact element 39 and the wheels 15 and 16. The centre of gravity will be spaced only a moderate distance from the wheels. It will be noted that the line on which the wheels contact a level floor will be spaced from the vertical plane containing the centre of gravity by a distance which is significantly less than one half of the overall width of the case, measured from the hinge 14 to the peripheral wall portion 12 which lies beyond the pivot axis 19. Even when a stack of loaded cases is placed on the face 11, the position of the vertical plane containing the overall centre of gravity will be near to the centre of gravity of the case alone and tipping of the loaded case from the attitude represented in FIG. 3 to raise the contact element 39 from the floor can be effected relatively easily, as compared with the effort which would be required under corresponding conditions if the wheels 15 and 16 projected from the peripheral wall 12, rather than from the major face 21.

The wheel 15 and carrier 17 occupy a narrow slot defined by the body 10. The wheel 16 and carrier occupy a further narrow slot defined by the body. When the case is in the extended configuration the wheels protrude partly from these slots through the major face 21 but do not protrude from the slots through the peripheral face of the case. The space between these slots is available to accommodate articles contained in the case. These slots and the channels in the face 41 represent only a minor proportion of the overall volume of the case. Similarly, the housings for the reels 40 encroach on the space inside the case only at spaced positions and only to a relatively small degree.

Figure 3:
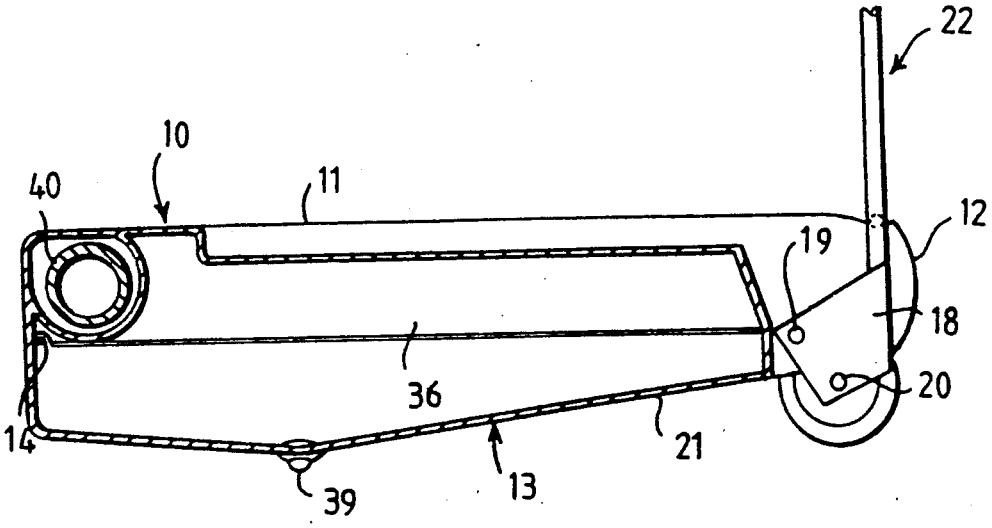
FIG. 3 shows a cross-section through the case with the mast in the extended position.

As can be seen from FIG. 3, the pivot axis 19 is spaced from the adjacent corner where the face 21 merges with the peripheral face 12, is spaced from this corner in a direction towards the opposite peripheral face and is so spaced by a distance which is greater than the radius of the wheels and is almost equal to the diameter of the wheels. In the contracted configuration, the pivot axis 19 lies between the wheel axis and the face 21. A plane which contains both of these axes, that is, the plane in which both the wheel axis 20 and the pivot axis 19 lie, intersects the face 21 but does not intersect the face 11. When the case is in the extended configuration, a plane containing both the pivot axis 19 and the wheel axis 20 intersects both of the faces 21 and 11. Also, that point on each wheel which is furthest from the remote face 11 is spaced in the same general direction from both of the major faces. In the contracted configuration, the pivot axis 19 lies substantially nearer to the major face 21 than does the wheel axis 20.

Figure 6:
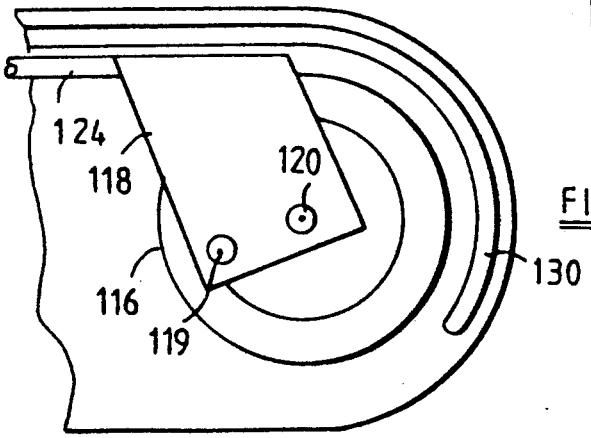
FIG. 6 shows, on another scale, an alternative geometry of a wheel and wheel carrier of the case.

An alternative geometry of a wheel and wheel carrier of the case 10 is illustrated in FIG. 6, where parts corresponding to those hereinbefore described with reference to FIGS. 1-5 are identified by the like numerals with the prefix 1 and the preceding description is deemed to apply, except for the difference hereinafter mentioned. As shown in FIG. 6, in this alternate embodiment, the radius of the wheels 116 exceeds the spacing of the wheel axis 120 from the pivot axis 119.

An example of means suitable for locking the pivot joint 27 is illustrated in FIG. 7. In this example, the joint 27 is a lapped pivot joint. There is privided an additional transverse member in the form of a rectilinear rod 44 which passes through aligned apertures in respective overlapped portions of the upper and lower parts of the side member 23 and through corresponding apertures in overlapped portions of the upper and lower parts of the side member 24, to provide the pivotal connection and define the pivot axis. The overlapped portions of the side member 23 have mutually opposed, serrated faces which can move into mutual engagement to restrain relative pivoting and which can move out of mutual engagement, by sliding along the rod 44. There is interposed between these mutually overlapped portions a disc spring 45 which urges the serrated surfaces out of mutual engagement. One of the surfaces is provided with a recess to receive the disc spring, when in a substantially flattened condition. The side member 24 is provided with corresponding serrated surfaces and a disc spring (not shown) arranged in the same manner.

A rotary cam mechanism is provided for driving the overlapped portions of the side member 23 into mutual engagement at their serrated faces, thereby collapsing the disc spring 45. The cam mechanism comprises a cam member 46 rotatably mounted on a central portion of the rod 44 and a tubular spacer 47 also mounted on the rod 44 to lie between the cam member 46 and the side member 23. The spacer 47 is slidable along the rod 44 but is keyed to the rod to prevent relative rotation. At its end, the rod 44 has a head 48. The mutually overlapped portions of the side member 23 are trapped between the head 48 and the spacer 47. One end portion of the spacer 47 is received within a socket defined by the cam member 46. This end portion has an end face 49 inclined to a longitudinal axis of the rod 44 and engaged with a similarly inclined face on the cam member 46. Accordingly, turning of the cam member drives the spacer 47 along the rod 44 in a direction away from the side member 24 so that the side member 23 is clamped firmly between the spacer and the head 48 with sufficient force to collapse the disc spring 45 and bring the serrated surfaces into mutual engagement. Turning of the cam member 46 concurrently drives a spacer 50 in a corresponding manner along the rod 44 in the opposite direction to clamp the side member 24 in a similar way. By a single rotational movement of a single cam member, the pivot joints of both of the side members 23 and 24 can be locked and by reversing that single movement can be unlocked. A known detent (not shown) may be provided for restraining inadvertent turning of the cam member. Suitable spring-loaded detents are well known. The cam member and associated parts may be formed plastics materials. Metals and plastics may both be used in the construction of these parts.

A spring-loaded detent 52 is provided for retaining the cam member 46 in a position to which it has been set. A button 53 is provided for transmitting motion from the user to the detent when the cam member is at one limit of its travel and a further button (not shown) is provided for transmitting motion to the detent when the cam member is at the other limit of its travel.

In FIG. 8, there is illustrated a mast which can be substituted for the mast 22. The mast of FIG. 8 carries the wheels 15 and 16 in the same manner as does the mast 22, is articulated and has pivot axes at positions corresponding to those of the mast 22. The upper part of the mast of FIG. 8 is a single moulding of a plastics material and the lower part of the mast is a further, single moulding of a plastics material. These mouldings may contain reinforcements of metals or other materials known for reinforcing plastics structures. Each of these parts is of generally plate-like form but includes corrugations or other formations to provide torsional and bending stiffness. The lower part of the mast of FIG. 8 is adapted to bear on the abutment 37 in the same manner as is the lower part of the mast 22 and the upper part of the mast shown in FIG. 8 includes curved hand-grip portions similar to those of the mast 22. Between these extends a handle suitable for carrying the case, when in the contracted condition. This handle may be constituted by a separtely formed bar incorporated in the moulded upper part 51.

In FIG. 8, parts corresponding to those hereinbefore described with reference to FIGS. 1 to 4 are identified by the like numerals with the prefix 1 and the preceding description is deemed to apply, except for the differences hereinafter mentioned.

To receive the mast of FIG. 8, the recess provided in the face 11 of the case would have a form different from that the recess provided to receive the mast 22. The mast of FIG. 8 may be formed to provide a substantially smooth external surface of the case, when in the contracted configuration.

A mast having the form of that shown in FIG. 8 may be fabricated from metal pressings, as an alternative to being formed of plastics mouldings.

In FIG. 9, there is illustrated a further alternative mast which may be substituted for the mast 22. The mast of FIG. 9 comprises a generally triangular lower part 50 and an upper part 51 which is connected with the lower part for telescoping movement relative thereto. The upper part may be generally T-shaped. The lower part may include a transverse member corresponding to the member 38 and adapted to bear on the abutment 37, when the case is in the extended configuration. The lower part also includes wheel carriers corresponding to the wheel carriers 17 and 18.

Figure 10:
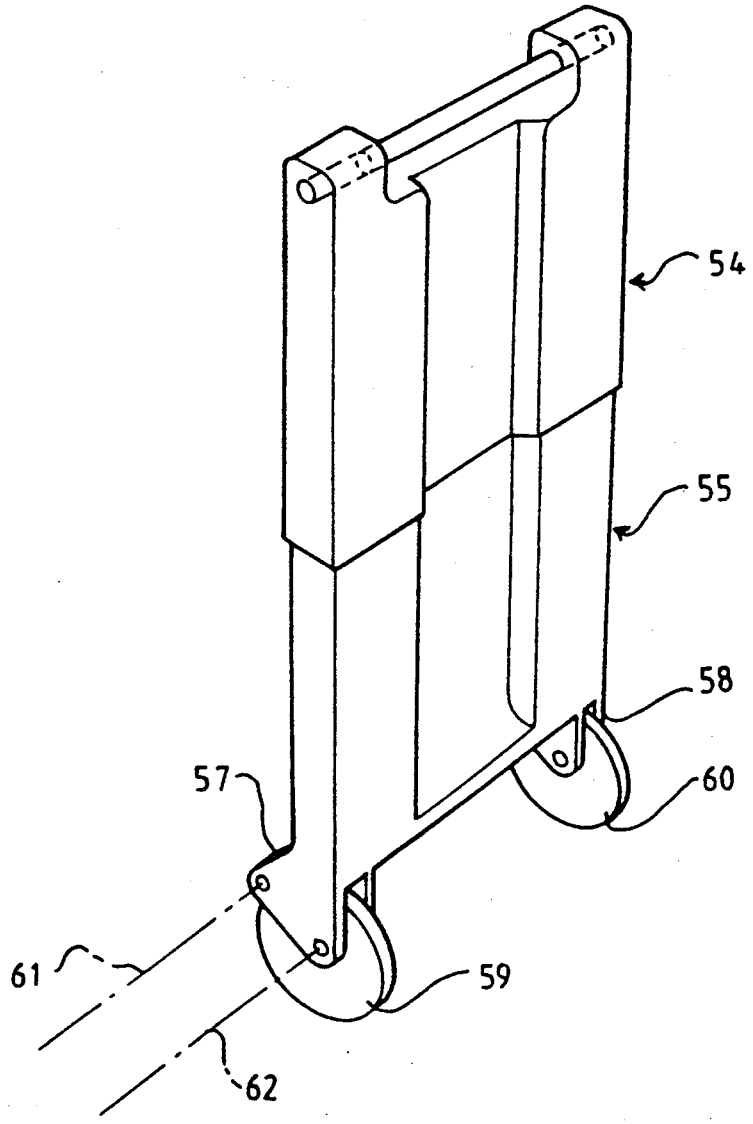
FIG. 10 illustrates a further modification of the geometry of the wheel and wheel carrier and an alternative mast.

A still further alternative mast which may be substituted for the mast 22 is illustrated in FIG. 10. The mast of FIG. 10 comprises upper and lower parts 54 and 55 which co-operate telescopically. The upper part incorporates handles 56 and the lower part has a rounded lower margin for bearing on the abutment 37 of the case body. As viewed along the length of the mast, the upper and lower parts are both of generally rectangular form but each major face includes at least one corrugation arranged with the length of the corrugation extending along the mast. The upper and lower mast parts may be formed of reinforced plastics materials.

The lower mast part 55 incorporates wheel carriers 57 and 58 for the wheels 59 and 60, these wheel carriers corresponding to the carriers 17 and 18. However, the geometry of the wheel carriers 57 and 58 differs from that of the carriers 17 and 18. The latter carriers pivot relative to the body 10 of the case about a pivot axis 19 which is spaced from the wheel axis 20 by a distance no greater than the radius of the wheels 15 and 16. Accordingly, the pivotal connection between each of the carriers 17 and 18 and the body 10 comprises a pair of stubs disposed one either side of the corresponding wheel. The geometry illustrated in FIG. 10 differs in that the pivot axis 61 is spaced from the wheel axis 62 by a distance exceeding significantly the radius of the wheels 59 and 60. Accordingly, the pivotal connection between the carrier 57 and the body of the case is constituted by a single pin which extends beyond opposite faces of the wheel 59. A corresponding pin constitutes the pivot connection between the carrier 58 and the case body. The pivot pins are co-axial. The geometry of the carriers illustrated in FIG. 10 may be used in the carriers 17 and 18 and in the other carriers hereinbefore described and shown in the drawings.

When a telescopic mast is provided, for example as illustrated in FIG. 9 or FIG. 10, there may be incorporated in the body of the case at a position generally between the wheels a handle which is fixed with respect to the main body of the case and which occupies a position corresponding to that of the member 31, shown in FIG. 2. Such a fixed handle can conveniently be used for carrying the case, when in the contracted configuration. Alternatively, the handle of a telescopic mast may be used for carrying the case, when in the contracted configuration. In this case, means will be provided for releasably latching the telescopic mast with respect to the body of the case, when in the contracted configuration. The handle of the telescopic mast may be arranged for pivoting relative to the upper part of the mast and clamping means as shown in FIG. 7 may be provided for releasably clamping the handle of the mast in a selected position.

We claim:

1. A case comprising a hollow body with a pair of opposite, external major faces and minor faces extending between the major faces, a single mast having a pair of side members, and a pair of wheels mounted on the mast for rotation relative thereto about a common wheel axis, wherein the mast is mounted on the body for pivoting of the mast and wheels together about a pivot axis common to the mast and the wheels between an extended configuration and a contracted configuration, wherein, in the extended configuration the mast extends from the body in a direction from one major face to the other, wherein said pivot axis is transverse to said direction, wherein said one major face has engaging means for engaging a level floor when the case is in the extended configuration with the mast projecting upwardly from the body and being substantially upright, the other of said major faces is an upper face of the body and is substantially parallel to the floor and the wheels project below said one face of the body into engagement with the floor, wherein the body includes opposed pairs of webs which extend from the pivot axis across said other of the major faces, wherein the body defines a respective recess between the webs of each pair and wherein, when in the contacted configuration, respective portions of the mast are received in said recesses.

2. A case according to claim 1 wherein the mast comprises upper and lower portions with pivot joints between said upper and lower portions, and said mast includes a handle portion such that when the case is in the contracted configuration, said handle portion lies immediately adjacent to a central part of a minor face of the body.

3. A case according to claim 1 wherein the mast includes a transverse portion extending between said side members, a channel is provided in said other major face, and said transverse portion bears on said other major face when the case is in the extended configuration.

4. A case according to claim 1 wherein the mast is an articulated mast and comprises first and second pivot joints providing for relative pivoting of upper and lower portions of the mast about a common axis, wherein said pivot joints are spaced apart along said common axis, wherein the mast includes clamping means for clamping the pivot joints of the mast against relative movement of the upper and lower mast portions and wherein the clamping means includes a handle portion which is movable relative to said upper and lower portions of the mast for applying clamping force to both of said pivot joints.

5. A case according to claim 1 wherein the mast is telescopic.

6. A case according to claim 1 wherein said side members comprise upper and lower portions with pivot points between said upper and lower portions, and the mast includes a pair of curved handles, on said side members, the body defines a pair of recesses for receiving respective ones of the wheels when the case is in the contracted configuration and wherein, when the case is in the contracted configuration, the handles extend partly around the circumference of respective ones of the wheels and lie in said recesses.

7. A case according to claim 1 wherein the body comprises a pair of further recesses which are remote from the wheels and wherein there is in each said further recess a reel carrying a strap.

8. A case comprising a hollow body with a pair of opposite, external major faces and minor faces extending between the major faces, a single mast having a pair of side members, and a pair of wheels mounted on the mast for rotation relative thereto about a common wheel axis, wherein the mast is mounted on the body for pivoting of the mast and the wheels together about a pivot axis common to the mast and the wheels between an extended configuration and a contracted configuration, wherein, in the extended configuration, the mast extends from the body in a direction from one major face to the other, wherein said pivot axis is transverse to said direction, wherein the wheels are mounted on the mast at opposite sides thereof, wherein the body is formed with a recess for receiving at least portions of the mast when in contracted configuration, and said body defines a pair of slots which are substantially spaced along the pivot axis from each other and from a pair of said minor faces, said recess spaced from both said minor faces by a distance corresponding to the spacing of said slots from said minor faces, such that said slots form extensions of said recess, and wherein the wheels are disposed in said slots when the mast is in the contracted configuration and wherein the radius of said wheels exceeds the spacing of the wheel axis from the pivot axis.

9. A case according to claim 8 wherein the mast is articulated and comprises upper and lower portions, two pivot joints between said portions and locking means associated with said joints for releasably locking said joints and wherein the locking means comprises a moveable member which is mounted for movement relative to both said upper and lower mast portions and which moveable member can be grasped and moved by a user to lock and unlock said pivot joints concurrently.

10. A case according to claim 8 wherein the mast comprises upper and lower portions with pivot joints between said upper and lower portions, and said mast includes a handle portion, such that when the mast is in the contracted configuration, said handle portion lies immediately adjacent to a central part of a minor face of the body.

11. A case according to claim 8 wherein the mast comprises upper and lower parts, each of plate-like form.

12. A case according to claim 8 wherein the body includes two pairs of webs which extend from the pivot axis across one of said major faces of the body, each of said slots is defined between the webs of a respective pair of said webs and wherein corresponding portions of the mast are received between the webs of each pair when the mast is in the contracted configuration.

13. A case according to claim 8 wherein the body has engaging means for engaging a level floor when the mast projects upwardly from the body in the extended configuration, the mast is substantially upright, the other of said major faces is an upper face of the body and is substantially parallel to the floor and the wheels project below said one face of the body into engagement with the floor.

14. A case according to claim 13 wherein said one major face diverges from the other major face in a direction from the wheels to the engaging means.

15. A case according to claim 8 wherein said side members comprise upper and lower portions with pivot joints between said upper and lower portions, and the mast includes a pair of curved handles and wherein, when the mast is in the contracted configuration, the handles extend partly around the circumference of respective ones of the wheels and lie in said slots.

* * * * *